United States Patent [19]

Skalka

[11] 4,002,299

[45] Jan. 11, 1977

[54] HYDRAULICALLY LOADED PULVERIZER JOURNAL

[75] Inventor: Clemens John Skalka, Simsbury, Conn.

[73] Assignee: Combustion Engineering, Inc., Windsor, Conn.

[22] Filed: Sept. 29, 1975

[21] Appl. No.: 617,357

[52] U.S. Cl. ..... 241/37; 241/132

[51] Int. Cl.[2] ..... B02C 4/32

[58] Field of Search ..... 241/37, 121, 122, 127, 241/128, 132, 133

[56] References Cited

UNITED STATES PATENTS

| | | | |
|---|---|---|---|
| 1,889,555 | 11/1932 | King | 241/121 |
| 2,909,330 | 10/1959 | Hardinge | 241/37 X |

*Primary Examiner*—Granville Y. Custer, Jr.
*Attorney, Agent, or Firm*—Robert L. Olson

[57] ABSTRACT

A control system for the hydraulic loading of the grinding rolls of a pulverizing mill, including a feedback servo system designed to incorporate a spring rate characteristic into the hydraulic loading of the grinding rolls.

5 Claims, 2 Drawing Figures

HYDRAULICALLY LOADED PULVERIZER JOURNAL

BACKGROUND OF THE INVENTION

Up until recently, almost all grinding rolls in pulverizing mills have been biased towards the grinding bowl by means of a mechanical coil spring. A few mills have used hydraulic pressure for biasing the rolls towards the grinding bowl, and although such hydraulic loading has many advantages, there has been one major drawback to the widespread adoption of such a hydraulic loading system. When using a mechanical spring for biasing the grinding rollers, there is an inherent spring rate characteristic built into it. Thus as the output requirements of the pulverizing mill are varied, resulting in a variation in the bed depth of the material between the grinding bowl and the grinding rollers, the force exerted by the spring, biasing the roller towards the bowl, is also changed. The spring is initially set with a given load, for example 50,000 pounds, when there is no material, such as coal, present on the bowl. Thus if the spring has a 50,000 pound per inch constant, it would initially be compressed one inch. When the bowl mill is operating at 100 percent capacity, there may be a two inch depth of coal on the bowl. This would result in a three inch compression of the spring, or a 150,000 pound force being exerted by the spring. If the mill is later run at 50 percent of maximum capacity, the depth of the coal bed on the bowl would be one inch, and the spring would then exert only a 100,000 pound force. This is desirable, because as the amount of pulverized material wanted from the mill increases, the pressure exerted by a mechanical spring also increases proportionally, thus permitting more material to be pulverized in a given time because of the increased force exerted by the spring.

This has not been the case with hydraulic loading systems in existance today. They are initially loaded to exert a predetermined force, for example 50,000 pounds, which force remains fairly constant regardless of the amount of material being pulverized. Thus if a mill is run at 50 percent capacity, the material is pulverized at a much faster rate than when it is run at 100 percent capacity. If the mill is feeding the material directly to a point of use, without an intermediate storage facility, this creates undue problems. Such is the case when a mill is used for supplying pulverized coal directly to a furnace of a steam generator, the output of which may vary from 30 to 100 percent at different times.

SUMMARY OF THE INVENTION

The pulverizing mill of the invention has hydraulic loading of the grinding rolls. A control circuit is provided for the loading which is designed to automatically increase or decrease the hydraulic pressure proportionally with increases and decreases of the mill output, just as a mechanical spring would. This is accomplished by using a servo system having a three position valve for controlling flow of hydraulic fluid to and from the hydraulic loading on the grinding roll. One side of the valve is biased by a spring, the compression of which is controlled by the position of the grinding roll in relation to the grinding bowl. The other side of the servo valve is biased by the pressure existing in the hydraulic loading system itself. Suitable damping means are provided for holding the servo valve in a steady state position while the grinding roll is subjected to normal temporary oscillations, or to prevent hunting.

DESCRIPTION OF THE PREFERRED EMBODIMENT

Figure 1:
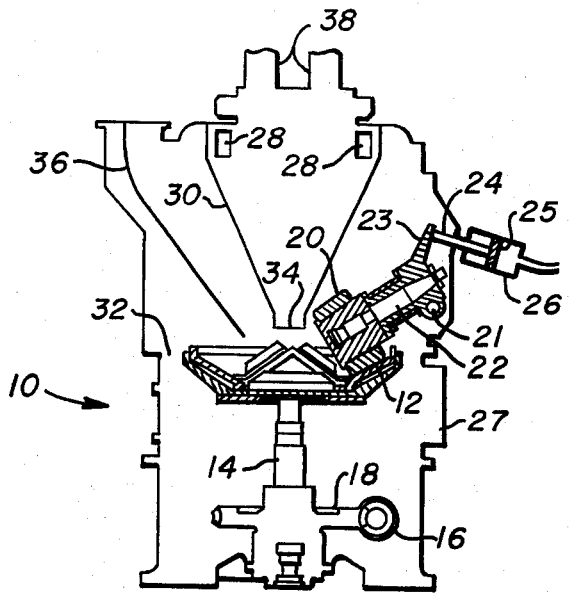
FIG. 1 is a sectional side view of a pulverizing mill having hydraulic loading on the grinding rolls.

Looking now to FIG. 1, numeral 10 designates a bowl mill for grinding coal or other material therein. Inside the housing is positioned a rotatable bowl or ring 12, mounted on shaft 14. Shaft 14 along with the attached bowl is rotated by means of worm wheel 18, which engages worm 16 mounted on a motor driven shaft.

One or more grinding elements or rollers 20 are rotatably mounted on shafts 22. There are generally three rollers 20 which are equidistantly spaced around the grinding bowl 12. Hydraulic pressure acting against piston 25 within the cylinder 26 forces piston 24 against the journal 23, thus urging the roller 20 towards the inner surface of the grinding ring 12. The roller 20 and its journal 23 are pivotally mounted on shaft 21 so that the roll can move towards and away from the bowl; depending on the depth of the bed of coal being pulverized.

Coal to be pulverized is introduced into the mill through inlet 36. Air enters through opening 27, and flows through annular space 32 to convey the ground material passing over the lip of bowl 12 by means of centrifugal action, upwardly through the mill interior and into the classifer 30. The air and coal enter the classifier through inlets 28. The larger particles of insufficiently ground coal fall back onto the grinding surface through bottom opening 34 for further grinding, and the finer particles are carried along by the air stream and are discharged through outlets 38.

Figure 2:
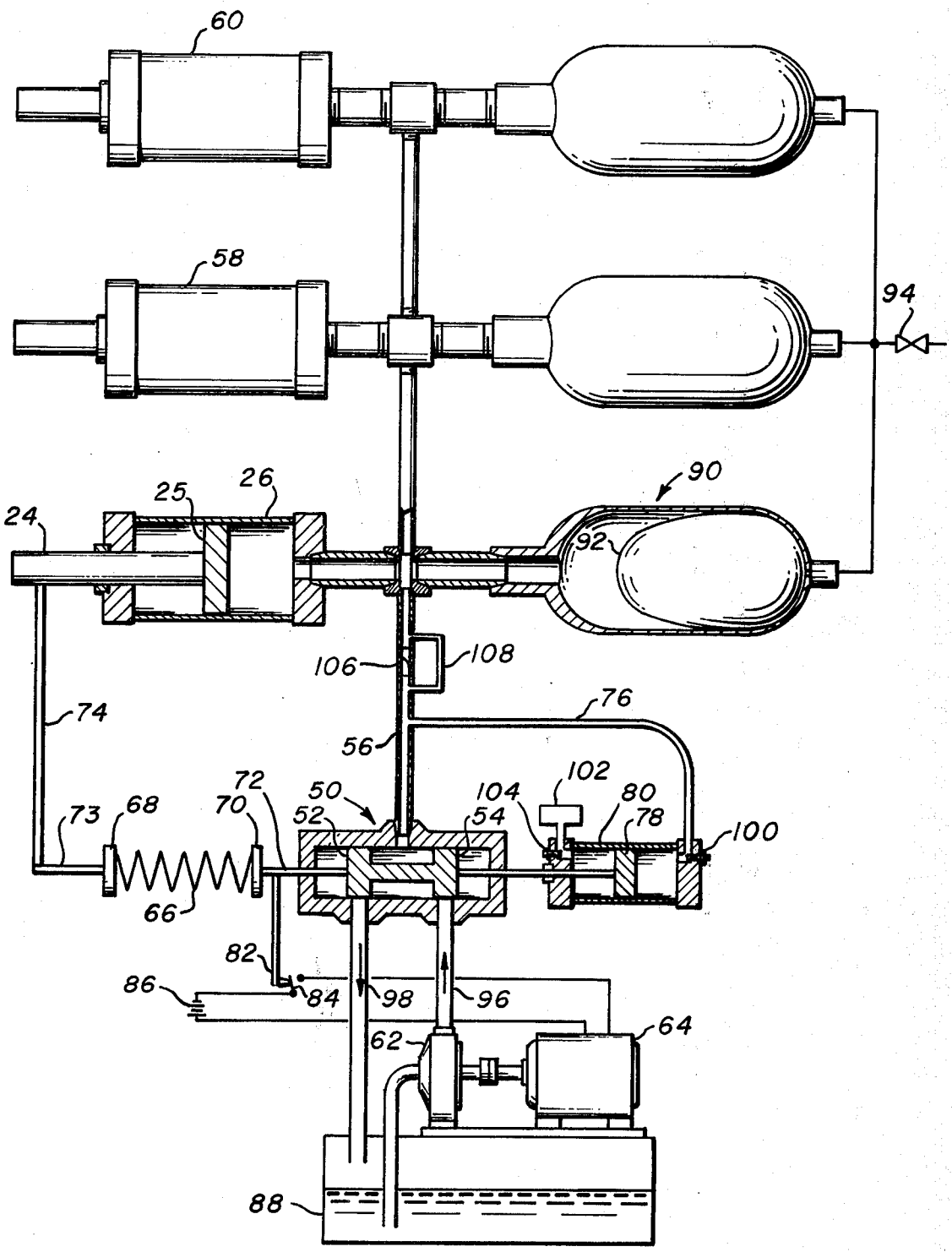
FIG. 2 is a partial sectional view of a control system for controlling the hydraulic loading pressure.

Looking now to FIG. 2 of the drawings, the control system for the hydraulic loading is shown. Hydraulic pressure is shown as being supplied to three cylinders 26, 58 and 60. Each of these cylinders would apply the hydraulic loading to one of the rollers such as shown at 20 in FIG. 1. The system is described in detail only with regard to the cylinder 26, which is applying hydraulic pressure to roller 20. It is to be understood that the control system would work in the same manner upon the cylinders 58 and 60, along with their corresponding rolls because of their common interconnection. The control system consists of a three position servo valve 50, having valve heads 52 and 54 therein. This servo valve controls the flow of hydraulic fluid through line 56 to and from each of the cylinders 26, 58 and 60. A pump 62, driven by a motor 64, supplies the hydraulic fluid to the system. A spring 66 located between spring seats 68 and 70, biases the left side of the servo valve through a rod 72, connecting the seat 70 to the valve head 52. The spring seat 68 contains a rod 73 thereon, which has a rigid arm attachment 74 to the rod 24, which acts against the roller journal 23 (FIG. 1). A bleed line 76 extends from pressure line 56 over to the right hand side of a piston 78 mounted in cylinder 80, said piston and cylinder comprising a hydraulic motor. This piston 78 biases the right side of the servo valve. Attached to rod 72 is a switch arm 82 containing switch 84 thereon. When this switch 84 is in its closed position it completes a circuit between the power source 86, and the motor 64. Numeral 88 indicates an oil sump or reservoir.

Each of the three grinding rolls has an associated hydraulic/pneumatic shock absorber chamber, the one associated with roll 12 (piston rod 24) being indicated by numeral 90. This hydraulic/pneumatic shock absorber consists of a diaphragm 92, with hydraulic fluid being supplied to the left hand side thereof through pressure line 56, with pneumatic pressure being exerted against the diaphragm on the right hand side. The pneumatic system is initially loaded through shutoff valve 94.

When the pump 62 is in operation, it supplies oil under pressure to the servo valve 50 through pipe 96. Oil can return from the pressure line 56 through the servo valve 50, through line 98, back to the reservoir 88 when the servo valve has moved to the left from the position shown in FIG. 2.

In order to prevent hunting of the servo valve, when there are transient temporary oscillations of a grinding roll, a damper system is provided for the servo valve. This consists of a throttle valve 100 positioned in line 76 which feeds the right hand side of piston 78. It also consists of a line running to a reservoir 102, which maintains the chamber on the left hand side of piston 78 full of hydraulic fluid at all times. The reservoir 102 is at atmospheric pressure, and its sole function is to perform a damping action of the servo valve by means of the throttle valve 104. The pressure line 56 through which hydraulic fluid is supplied to cylinder 26 contains a check valve 106 therein, and a bypass line 108 around the check valve 106, which will permit fluid to flow back to the reservoir from the hydraulic loading system when it is called for.

The operation of the above described apparatus will now be set forth. Looking to FIG. 1, coal to be pulverized is introduced unto the bowl 12 through chute 36. Hydraulic pressure urges the rolls 20 towards the upper surface of the bowl 12. As the bowl rotates, the coal is pulverized. As the coal is centrifugally flung off the bowl, it is picked up in the air stream and carried to the classifier 30, where the oversized particles are centrifugally separated out and returned to the bowl for further grinding.

When the mill is running at a steady output, the servo valve 50 (FIG. 2), remains stationary in a neutral position. The hydraulic loading on the rolls is initially set at a predetermined force, for example 50,000 pounds. The actual pressure of the hydraulic fluid necessary to exert a 50,000 pound force on roller 12 through rod 24 will depend on the area of piston 25. For example, if this area is 50 square inches, the pressure of the fluid would be 1,000 psi to result in a 50,000 pound force. The piston rod 24 is at this time compressing the spring 66 just sufficiently to counterbalance the force exerted by the pressure acting on the right hand side of piston 78, maintaining the servo valve 50 in its neutral position, closing all flow passages. Pump 62 is not operating at this time, since switch 84 is open. The spring constant of spring 66 divided by the area of piston 78 is made the same as the mechanical spring constant of the coil spring replaced by the hydraulic loading system divided by the area of piston 25.

If more coal is called for from the mill, so that the coal bed depth doubles, from one inch to two inches, rod 24 moves one inch to the right, thus also moving spring seat 68 one inch to the right. Since the spring is compressed twice as much, it overcomes the force of piston 78, allowing servo valve 50 to move to the right. This immediately closes switch 84, energizing the pump 62, and also places pressure line 56 in communication with the pump outlet line 96. This increases the pressure of the hydraulic fluid acting upon piston 25. This pressure will continue to increase until the pressure in line 76 becomes sufficient in acting against the right hand side of piston 78 to balance the force exerted by spring 66. This will happen when the pressure had doubled, if the coal bed depth has doubled. At this time, the servo valve 50 has again moved back to its neutral position, and switch 84 is open, shutting off pump 62.

If the mill output is decreased, the piston rod 24 moves to the left, moving spring seat 68 also to the left. This relaxes the spring 66, causing piston 78 to move the servo valve 50 to the left to allow fluid from the hydraulic system to return to the pump 88. Switch 84 remains open, and thus pump 62 is inoperative. When sufficient pressure is relieved from the hydraulic loading system so that the spring 66 exerts a balanced force against the piston 78 to servo valve 50 will again move to its neutral position.

During the normal operation of a mill operating at a given capacity output, bed depth variations are constantly encountered. For example, piston rod 24 may move back and forth as much as one-half inch many cycles every minute. It would be undesirable to have the servo valve 50 hunting during these rapid, normal oscillations. For this reason throttle valves 100 and 104 are provided. These valves restrict flow from either side of the piston 78 sufficiently so that unless a pressure unbalance across the servo valve 50 exists for an extended period of time, there will be no movement of the servo valve 50. The time of response of the servo valve can be set by the degree of throttling of valves 100 and 104; i.e., the more they are closed, the longer the time an unbalance must exist before the servo valve will be moved, and vise versa.

The purpose of the hydraulic/pneumatic shock absorber 90 is to tke care of sudden large movements of a roller 20. For example, coal with roughly one inch diameter size would normally be fed to the mill. Occasionally, a piece of metal or other hard foreign matter with a diameter of two or three inches finds its way into the mill. When a roller encounters this, rod 24 will rapidly move back a couple of inches to allow the large piece to pass between the bowl 12 and roller 20. The pneumatic side of diaphragm 92 is filled through valve 94 initially, for example to a predetermined pressure of 800 psi, or approximately 80 percent of the initial hydraulic pressure loading. Valve 94 is then closed. Thus when a grinding roll encounters a large item, the hydraulic fluid immediately compresses the gas in the shock absorber. Most of this shock is absorbed by the absorber associated with the particular roll, but some is also absorbed by the other shock absorber through the common piping. Check valve 106 prevents this large pressure peak from surging back to the servo valve 50. The purpose of the bleed line 108 is to permit hydraulic fluid to be exhausted from the hydraulic system at a controlled rate when the mill output is reduced. A minimal fraction of the transient pressure peak admittedly may pass through bypass line 108, but since the surge is of such short duration, the bulk of it is absorbed by the shock absorbers. Eventually the metal piece or other foreign substance will be flung out of the bowl, and since it would be too heavy to be picked up by the air stream, it will fall to the bottom of the mill housing and remain there until removed.

What is claimed is:

1. In a pulverizing mill, an upright grinding bowl, means for rotating the bowl, a grinding roll cooperating with the upper surface of the bowl to perform the pulverizing therebetween, fluid loading means forcing the roll toward the bowl, control means for controlling the pressure of the fluid contained in the fluid loading means, said control means including a pump, a reservoir for supplying fluid to the pump, a first pipe extending from the pump to the loading means, a servo valve located in the first pipe, a second pipe extending between the servo valve and the reservoir, the servo valve having three positions, a first position in which fluid can pass from the pump to the loading means, a second position in which fluid can pass from the loading means to the reservoir, and a third position in which no fluid flow takes place, a mechanical spring, a piston and cylinder arrangement which is subjected to the pressure contained in the fluid loading means, a first spring seat on one end of the spring which is interconnected to the roll in such a manner that it moves with the roll, a second spring seat on the other end of the spring which is connected to the piston and cylinder arrangement and moves therewith, the spring, piston and cylinder arrangement all being related to the servo valve such that when the roll is in a steady state the servo valve is in its third position, if the roll moves towards the upper surface of the bowl, the servo valve is moved to its second position, and if the roll moves away from the upper surface of the bowl the servo valve is moved to its first position.

2. The pulverizing mill set forth in claim 1, including shock absorber means in fluid communication with the loading means to absorb the shock of large, short term movements of the grinding roll.

3. The pulverizing mill set forth in claim 1, including damping means connected to the piston and cylinder arrangement for holding the servo valve in its third position when there are rapid cycling, small movements of the roll towards and away from the bowl.

4. The pulverizing mill set forth in claim 1, including a motor for driving the pump, an electrical circuit for the motor, a normally open switch located in the circuit, and means connected to the servo valve which closes the switch and maintains it closed when the servo valve is in its first position.

5. The pulverizing mill set forth in claim 1, wherein there are a plurality of grinding rolls, each grinding roll has its own fluid loading means, and the control means controls the pressure of the fluid in all of the loading means.

* * * * *